US006836210B2

(12) United States Patent
Tanguay

(10) Patent No.: US 6,836,210 B2
(45) **Date of Patent: *Dec. 28, 2004**

(54) ADVERSE CONDITION DETECTOR HAVING MODULATED TEST SIGNAL

(75) Inventor: William P. Tanguay, Downers Grove, IL (US)

(73) Assignee: Maple Chase Company, Downers Grove, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/292,175

(22) Filed: Nov. 12, 2002

(65) Prior Publication Data

US 2004/0090325 A1 May 13, 2004

(51) Int. Cl.[7] ..... G08B 29/00

(52) U.S. Cl. ..... 340/514; 340/506; 340/516; 340/3.1

(58) Field of Search ..... 340/514, 506, 340/516, 3.1, 584, 587

(56) References Cited

U.S. PATENT DOCUMENTS

| | | | | |
|---|---|---|---|---|
| 4,309,695 A | | 1/1982 | Guillemot | |
| 4,321,466 A | | 3/1982 | Mallory et al. | |
| 4,792,797 A | | 12/1988 | Tanguay et al. | 340/628 |
| RE33,920 E | | 5/1992 | Tanguay et al. | 340/628 |
| 5,936,524 A | * | 8/1999 | Zhevelev et al. | 340/552 |
| 6,348,871 B1 | | 2/2002 | Tanguay et al. | 340/628 |
| 6,451,219 B1 | | 9/2002 | Iyengar et al. | |
| 6,547,983 B2 | | 4/2003 | Iyengar | |
| 6,592,772 B2 | | 7/2003 | Foister et al. | |
| 6,599,439 B2 | | 7/2003 | Iyengar et al. | |
| 6,638,443 B2 | | 10/2003 | Iyengar et al. | |
| 6,642,849 B1 | * | 11/2003 | Kondziolka | 340/628 |

* cited by examiner

*Primary Examiner*—Daryl Pope
(74) *Attorney, Agent, or Firm*—Andrus, Sceales, Strike & Sawall, LLP

(57) ABSTRACT

An adverse condition detect or that allows the user to test the apparatus in close proximity without having to endure full operational alarm activation. The adverse condition detector includes a detector, a transducer and a test system. When the detector senses an adverse condition, the transducer is activated to generate an alarm signal having an alarm level. When the test switch is activated, a test signal is generated at the alarm level and has a test duration that is substantially less than the duration of the alarm signal. In one embodiment of the invention, the alarm signal includes a plurality of alarm pulses having an alarm pulse duration and the test signal includes a plurality of test pulses each having a test pulse duration substantially less than the alarm pulse.

29 Claims, 3 Drawing Sheets

ADVERSE CONDITION DETECTOR HAVING MODULATED TEST SIGNAL

BACKGROUND OF THE INVENTION

The present invention generally relates to residential alarms for detecting an adverse condition in a building. More specifically, the present invention is directed to a method and system for providing an improved test system for an adverse condition detector.

Alarm systems which detect dangerous conditions in a home or business, such as the presence of smoke, carbon dioxide or other hazardous elements, are extensively used to prevent death or injury. In recent years, it has been the practice to interconnect different alarm units which are located in different rooms of a home. Specifically, smoke detecting systems for warning inhabitants of a fire include multiple detectors installed in the individual rooms of a home, and the detectors are interconnected so that the alarms of all the detectors will sound if only one detector senses any combustion products produced by a fire. In this way, individuals located away from the source of the combustion products are alerted as to the danger of fire, as well as those in closer proximity to the fire.

In an effort to maintain the effectiveness of the multiple adverse condition detectors positioned throughout a home, such detectors are provided with a manual test switch. Manufacturers recommend that occupants test each of the adverse condition detectors periodically by pressing the manual test switch and observing if the detector produces a perceptible indication that the alarm is operational, usually by sounding an audible alarm and optionally providing a visual signal from a LED. In addition, battery powered models of such detectors include a battery power monitoring circuit that automatically sounds the audible alarm with a unique sound if a low battery power condition occurs.

Unfortunately, lack of maintenance or improper maintenance may not alert the user that the adverse condition detector is inoperative, and consequently it may not respond when the ambient adverse conditions increase to an undesirable level. This can occur when the owner of the detector has not maintained the detector in proper working condition by failing to check the operability of the detector with the manual test switch on a regular basis as suggested.

One reason why owners do not check the operability of an adverse condition detector at regular intervals results from the fact that such detectors produce an alarm that can be extremely annoying or even painful when the user is in close proximity to the detector.

One solution to this problem is embodied in the Tanguay et al. U.S. Pat. No. 6,348,871. In this system, when the test switch is depressed, an attenuated alarm signal is generated by a transducer, such as an audible horn. The attenuated operational alarm signal decreases the output level of the alarm for at least the first two pulses of a series of alarm pulses that define the alarm signal. By reducing the output level of the first two pulses, the user is able to test the alarm at close range without the uncomfortable sound generated at the maximum level for the transducer, and furthermore the user is allowed to become progressively accustomed to the shrill horn sound. This type of system is embodied by the Model FADC available from Maple Chase of Ill. In the Model FADC produced by Maple Chase, the first two pulses of the temporal alarm signal are generated at two-thirds the full voltage, while the third pulse is generated at full voltage.

Although the attenuation of the voltage applied to the piezoelectric horn reduces the volume of the alarm signal when a user is testing the device, a reduction in the voltage applied to the horn can sometimes cause the horn to produce an inconsistent sound in addition to the lower volume. Although the horn may be operating properly at the lower voltage level, an uninformed user many times reached the conclusion after the first two horn pulses that the horn was not operating correctly due to the slightly different sound generated. Thus, although the prior art system was conceptually functional, the occasional misinterpretation of the poor horn quality presented an opportunity for improvement.

Therefore, it is an object of the present invention to provide an improved test feature that allows the alarm indicator or transducer of the adverse condition detection apparatus to be operated to generate an apparently reduced magnitude alarm signal for the initial output pulses while still applying a full amplitude signal to such transducer. Additionally, it is an object of the present invention to reduce the acoustic magnitude of the perceived alarm output to reduce the impact on the user while operating the transducer according to its optimal characteristics, such that a user perceives proper operation of the device.

SUMMARY OF THE INVENTION

The present invention provides an adverse condition detector that enables a user to test the detector in close proximity without having to endure a fully operational alarm signal. The detector of the invention includes a control unit coupled to an adverse condition sensor that is operable to detect an adverse condition in an area near the apparatus. When an adverse condition is detected, the control unit generates an alarm signal through an alarm indicator coupled to the control unit. Preferably, the alarm signal has an alarm level and an alarm duration. In one embodiment of the invention, the alarm signal includes a plurality of alarm pulses each having an alarm pulse duration and the alarm level.

The adverse condition detector of the invention further includes a test switch coupled to the control unit that allows the user to activate the test switch to test the operation of the adverse condition detector. Upon activation of the test switch, a test request is received at the control unit indicating the beginning of a test sequence.

Upon receiving the test request, the control unit generates a test signal that is received by the alarm indicator for indicating to the user that the detector is operating correctly. Preferably, the test signal is generated at the alarm level and for a test duration substantially less than the alarm duration. Since the duration of the test signal is less than the duration of the alarm signal, the user is not subjected to the full operation of the alarm signal during the test sequence.

In one embodiment of the invention, the test signal includes a plurality of pulse trains each having a duration substantially equal to the duration of each alarm pulse in the alarm signal. Each pulse train of the test signal includes at least one test pulse. Each test pulse is generated at the alarm level and for a test pulse duration that is substantially less than the duration of the alarm pulse. Thus, the reduced duration of the test pulses as compared to the duration of each alarm pulse enables a user to test the apparatus in close proximity without having to endure a fully operational alarm signal.

In one embodiment of the invention, the first pulse train of the test signal includes a single test pulse, while the second and third pulse trains include an increasing number of test pulses. Thus, when the test signal is generated, the user is presented with an increasing number of test pulses to indicate proper operation of the adverse condition detector. In the most preferred embodiment of the invention, the first pulse train includes a single test pulse, the second pulse train includes a pair of test pulses, and the third pulse train includes three test pulses. However, varying numbers of test pulses within each of the pulse trains is contemplated as being within the scope of the present invention.

The foregoing has outlined rather broadly the features and technical advantages of the present invention in order that the detailed description of the invention that follows may be better understood. It should be appreciated by those skilled in the art that the use of various types of output transducers and adverse condition detectors can be utilized while operating within the scope of the present invention. It should also be realized by those skilled in the art that such equivalent constructions do not depart from the spirit and scope of the invention as set forth in the appended claims.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
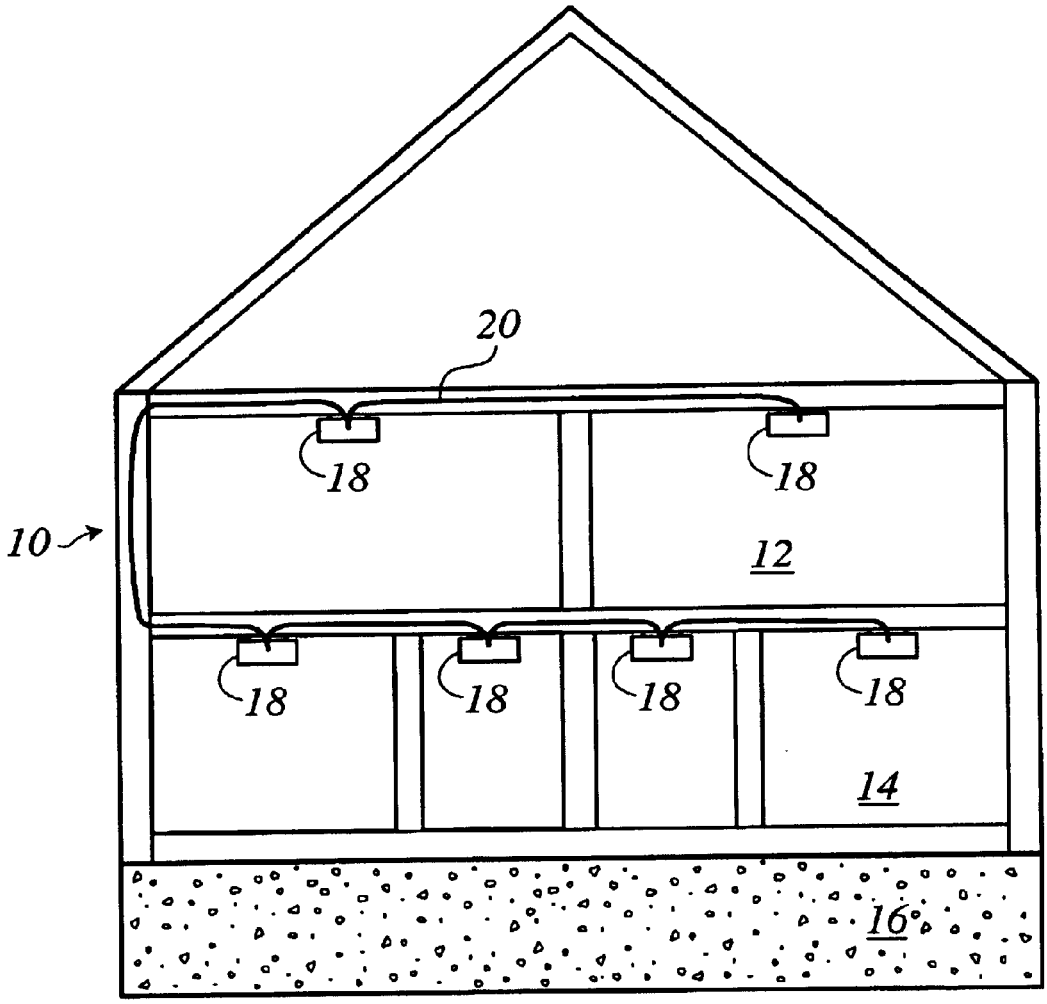
FIG. 1 is a general view of a plurality of remote adverse condition detectors that are interconnected with a common conductor.

FIG. 1 illustrates a facility 10 having multiple levels 12, 14 and 16 with rooms on each level. As illustrated, an adverse condition detector 18 is located in each of the rooms of the facility 10 and the detectors 18 are interconnected by a pair of common conductors 20. The plurality of adverse condition detectors 18 can communicate with each other through the common conductors 20.

In FIG. 1, each of the adverse condition detectors 18 is configured to detect a dangerous condition that may exist in the room in which it is positioned. Generally speaking, the adverse condition detector 18 may include any type of device for detecting an adverse condition for the given environment. For example, the detector 18 could be a smoke detector (e.g., ionization, photo-electric) for detecting smoke indicating the presence of a fire. Other detectors could include but are not limited to carbon monoxide detectors, aerosol detectors, gas detectors including combustible, toxic and pollution gas detectors, heat detectors and the like.

In the embodiment of the invention to be described, the adverse condition detector 18 is a combination smoke and carbon monoxide detector, although the features of the present invention could be utilized in many of the other detectors currently available or yet to be developed that provide an indication to a user that an adverse condition exists.

Figure 2:
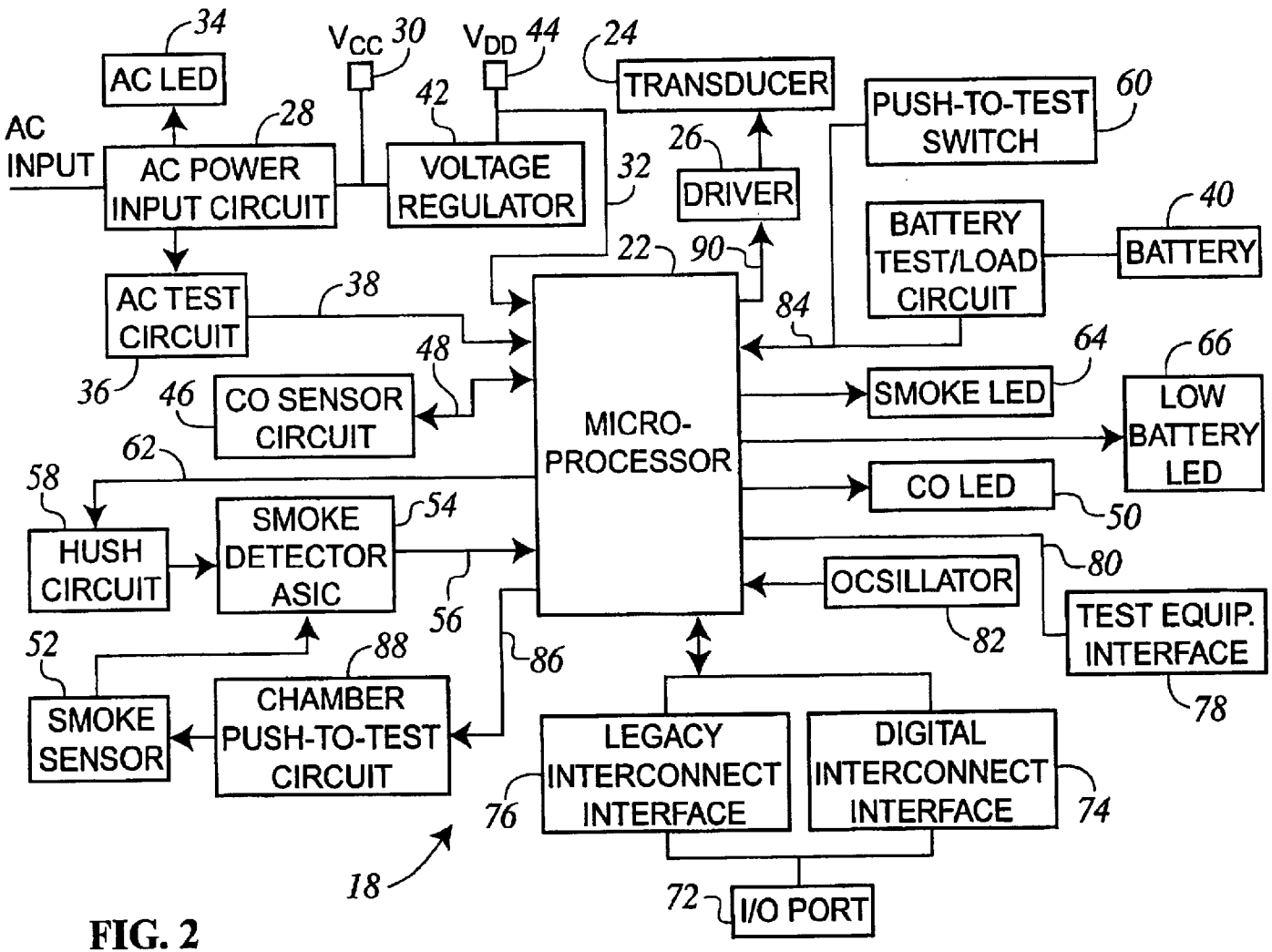
FIG. 2 is a block diagram of an adverse condition detector apparatus of the present invention.

Referring now to FIG. 2, thereshown is a block diagram of the adverse condition detector 18 of the present invention. As described, the adverse condition detector 18 of the present invention is a combination smoke and CO detector.

The adverse condition detector 18 includes a central microprocessor 22 that controls the operation of the adverse condition detector 18. In the preferred embodiment of the invention, the microprocessor 22 is available from Microchip as Model No. PIC16LF73, although other microprocessors could be utilized while operating within the scope of the present invention. The block diagram of FIG. 2 is shown on an overall schematic scale only, since the actual circuit components for the individual blocks of the diagram are well known to those skilled in the art and form no part of the present invention.

As illustrated in FIG. 2, the adverse condition detector 18 includes an alarm indicator or transducer 24 for alerting a user that an adverse condition has been detected. Such an alarm indicator or transducer 24 could include but is not limited to a horn, a buzzer, siren, flashing lights or any other type of audible or visual indicator that would alert a user of the presence of an adverse condition. In the embodiment of the invention illustrated in FIG. 2, the transducer 24 comprises a piezoelectric resonant horn, which is a highly efficient device capable of producing an extremely loud (85 dB) alarm when driven by a relatively small drive signal.

The microprocessor 22 is coupled to the transducer 24 through a driver 26. The driver 26 may be any suitable circuit or circuit combination that is capable of operably driving the transducer 24 to generate an alarm signal when the detector detects an adverse condition. The driver 26 is actuated by an output signal from the microprocessor 22.

As illustrated in FIG. 2, an AC power input circuit 28 is coupled to the line power within the facility. The AC power input circuit 28 converts the AC power to an approximately 9 volt DC power supply, as indicated by block 30 and referred to as $V_{CC}$. The adverse condition detector 18 includes a green AC LED 34 that is lit to allow the user to quickly determine that proper AC power is being supplied to the adverse condition detector 18.

The adverse condition detector 18 further includes an AC test circuit 36 that provides an input 38 to the microprocessor 22 such that the microprocessor 22 can monitor for the proper application of AC power to the AC power input circuit 28. If AC power is not available, as determined through the AC test circuit 36, the microprocessor 22 can switch to a low-power mode of operation to conserve energy and extend the life of the battery 40.

The adverse condition detector 18 includes a voltage regulator 42 that is coupled to the 9 volt $V_{CC}$ 30 and generates a 3.3 volt supply $V_{DD}$ as available at block 44. The voltage supply $V_{DD}$ is applied to the microprocessor 22 through the input line 32, while the power supply $V_{CC}$ operates many of the detector-based components as is known.

In the embodiment of the invention illustrated in FIG. 2, the adverse condition detector 18 is a combination smoke and carbon monoxide detector. The detector 18 includes a carbon monoxide sensor circuit 46 coupled to the microprocessor 22 by input line 48. In the preferred embodiment of the invention, the CO sensor circuit 46 includes a carbon monoxide sensor that generates a carbon monoxide signal on input line 48. Upon receiving the carbon monoxide signal on line 48, the microprocessor 22 determines when the sensed level of carbon monoxide has exceeded one of many different combinations of concentration and exposure time (time-weighted average) and activates the transducer 24 through the driver 26 as well as turning on the carbon monoxide LED 50. In the preferred embodiment of the invention, the carbon monoxide LED 50 is blue in color, although other variations for the carbon monoxide LED are contemplated as being within the scope of the present invention.

In the preferred embodiment of the invention, the microprocessor 22 generates a carbon monoxide alarm signal to the transducer 24 that is distinct from the alarm signal generated upon detection of smoke. The specific audible pattern of the carbon monoxide alarm signal is an industry standard and is thus well known to those skilled in the art.

In addition to the carbon monoxide sensor circuit 46, the adverse condition detector 18 includes a smoke sensor 52 coupled to the microprocessor through a smoke detector ASIC 54. The smoke sensor 52 can be either a photoelectric or ionization smoke sensor that detects the presence of smoke within the area in which the adverse condition detector 18 is located. In the embodiment of the invention illustrated, the smoke detector ASIC 54 is available from Allegro as Model No. A5368CA and has been used as a smoke detector ASIC for numerous years.

When the smoke sensor 52 senses a level of smoke that exceeds a selected value, the smoke detector ASIC 54 generates a smoke signal along line 56 that is received within the central microprocessor 22. Upon receiving the smoke signal, the microprocessor 22 generates an alarm signal to the transducer 24 through the driver 26. The alarm signal generated by the microprocessor 22 has a pattern of alarm pulses followed by quiet periods to create a pulsed alarm signal as is standard in the smoke alarm industry. The details of the generated alarm signal will be discussed in much greater detail below.

As illustrated in FIG. 2, the adverse condition detector 18 includes a hush circuit 58 that quiets the alarm being generated by modifying the operation of the smoke detector ASIC 54 upon activation of the test switch 60. If the test switch 60 is activated during the generation of the alarm signal due to smoke detection by the smoke sensor 52, the microprocessor 22 will output a signal on line 62 to activate the hush circuit 58. The hush circuit 58 adjusts the smoke detection level within the smoke detector ASIC 54 for a selected period of time such that the smoke detector ASIC 54 will moderately change the sensitivity of the alarm-sensing threshold for the hush period. The use of the hush circuit 58 is well known and is described in U.S. Pat. Nos. 4,792,797 and RE33,920, incorporated herein by reference.

At the same time the microprocessor 22 generates the smoke alarm signal to the transducer 24, the microprocessor 22 activates LED 64 and provides a visual indication to a user that the microprocessor 22 is generating a smoke alarm signal. Thus, the smoke LED 64 and the carbon monoxide LED 50, in addition to the different audible alarm signal patterns, allow the user to determine which type of alarm is being generated by the microprocessor 22. The detector 18 further includes a low-battery LED 66.

When the microprocessor 22 receives the smoke signal on line 56, the microprocessor 22 generates an interconnect signal through the IO port 72. In the preferred embodiment of the invention, the interconnect signal is delayed after the beginning of the alarm signal generated to activate the transducer 24. However, the interconnect signal could be simultaneously generated with the alarm signal while operating within the scope of the present invention. The IO port 72 is coupled to the common conduit 20 (FIG. 1) such that multiple adverse condition detectors 18 can be joined to each other and sent into an alarm condition upon detection of an adverse condition in any of the adverse condition detectors 18.

Referring back to FIG. 2, the adverse condition detector 18 includes both a digital interconnect interface 74 and a legacy interconnect interface 76 such that the microprocessor 22 can both send and receive two different types of signals through the IO port 72. The digital interconnect interface 74 is utilized with a microprocessor-based adverse condition detector 18 and allows the microprocessor 22 to communicate digital information to other adverse condition detectors through the digital interconnect interface 74 and the IO port 72.

As an enhancement to the adverse condition detector 18 illustrated in FIG. 2, the legacy interconnect interface 76 allows the microprocessor 22 to communicate to so-called "legacy alarm" devices. The prior art legacy alarm devices issue a continuous DC voltage along the interconnect common conduit 20 to any interconnected remote device. In the event that a microprocessor-based detector 18 is utilized in the same system with a prior art legacy device, the legacy interconnect interface 76 allows the two devices to communicate over the IO port 72.

A test equipment interface 78 is shown connected to the microprocessor 22 through the input line 80. The test equipment interface 78 allows test equipment to be connected to the microprocessor 22 to test various operations of the microprocessor and to possibly modify the operating instructions contained within the microprocessor 22.

An oscillator 82 is connected to the microprocessor 22 to control the internal clock within the microprocessor 22, as is conventional.

During normal operating conditions, the adverse condition detector 18 includes a push-to-test system 60 that allows the user to test the operation of the adverse condition detector 18. The push-to-test switch 60 is coupled to the microprocessor 22 through input line 84. When the push-to-test switch 60 is activated, the voltage $V_{DD}$ is applied to the microprocessor 22. Upon receiving the push-to-test switch signal, the microprocessor generates a test signal on line 86 to the smoke sensor via chamber push-to-test circuit 88. The push-to-test signal also generates appropriate signals along line 48 to test the CO sensor and circuit 46.

The chamber push-to-test circuit 88 modifies the output of the smoke sensor such that the smoke detector ASIC 54 generates a smoke signal 56 if the smoke sensor 52 is operating correctly, as is conventional. If the smoke sensor 52 is operating correctly, the microprocessor 22 will receive the smoke signal on line 56 and generate a smoke alarm signal on line 90 to the transducer 24.

As discussed previously, upon depression of the push-to-test switch 60, the transducer 24 generates an alarm signal. Since the transducer 24 of the present invention is a piezoelectric horn that generates an extremely loud audible alarm, a need and desire exists for the transducer 24 to generate a "scaled down" alarm signal that is not as annoying and painful to a user who is near the transducer. In prior art systems, such as those embodied by U.S. Pat. No. 6,348,871, the amplitude of the alarm signal is reduced for at least a portion of the initial period of the alarm signal to prevent the loud alarm signal from being generated near the user's ears.

As discussed previously, this type of system has perceived drawbacks in that the transducer 24 may sound different or unusual when operated at less than the full signal amplitude.

Figure 3:
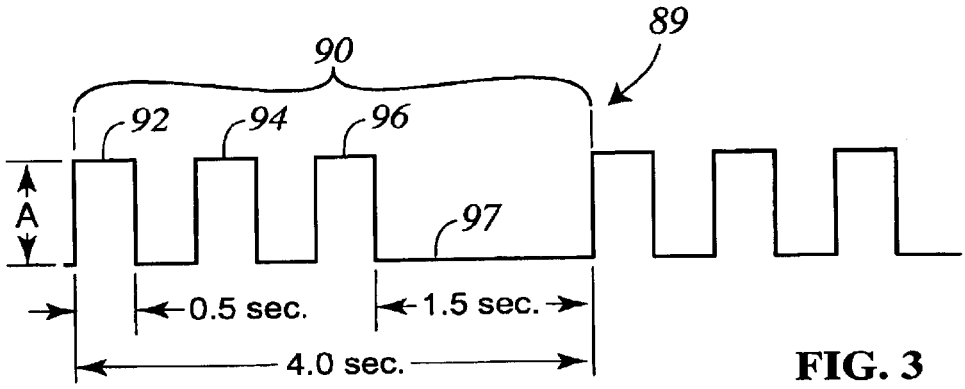
FIG. 3 is the alarm signal produced by the adverse condition detection apparatus of the present invention.

Referring now to FIG. 3, thereshown is the standard format for an audible alarm signal generated by a smoke detector. As illustrated, the alarm signal has an alarm period 90 that includes three alarm pulses 92, 94 and 96 each having a pulse duration of 0.5 seconds separated by an off time of 0.5 seconds. After the third alarm pulse 96 is generated, the temporal signal has an off period 97 of approximately 1.5 seconds such that the overall period 90 is 4.0 seconds. As illustrated in FIG. 3, each alarm pulse of the alarm signal 89 has an amplitude A such that each of the alarm pulses sounds the same. After completion of the first alarm period 90, the period is continuously repeated as long as an adverse condition exists.

Figure 4:
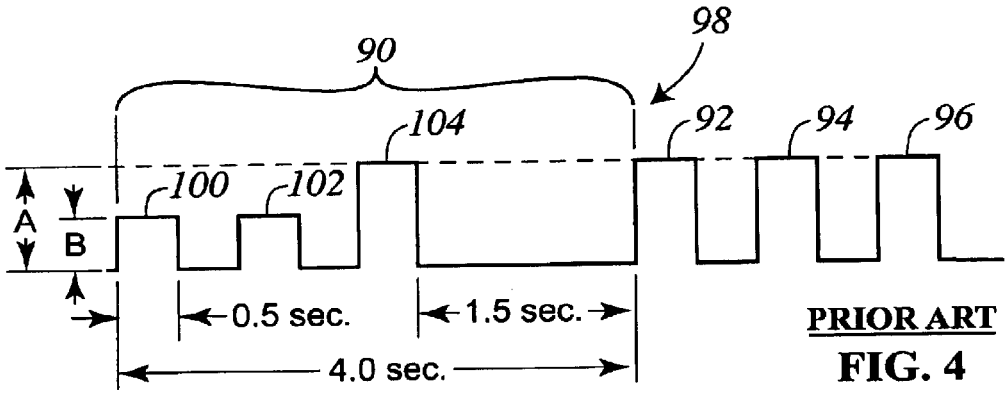
PRIOR ART FIG. 4
FIG. 4 is an alarm signal produced by a prior art adverse condition detection apparatus that attenuates the magnitude of the first two pulses upon actuation of a test switch.

Referring now to FIG. 4, thereshown is an attenuated alarm signal 98 generated by a prior art adverse condition detector. As illustrated in FIG. 4, upon activation of the test switch, the detector generates a first alarm pulse 100 having the same duration as the first pulse 92 of the alarm signal shown in FIG. 3. However, the alarm pulse 100 has an amplitude B that is less than the amplitude A of the alarm pulses 92, 94 and 96. The reduced amplitude of the alarm pulse 100 causes the piezoelectric horn to generate the audible signal having a lower volume.

In the embodiment illustrated in FIG. 4, a second alarm pulse 102 also includes the attenuated amplitude B such that the first two pulses 100, 102 after activation of the test switch are generated at a lower volume. The third pulse 104 has the normal amplitude A, as do the following pulses 92, 94 and 96 of the second cycle.

Although the prior art amplitude attenuated alarm signal 98 functions well to reduce the volume of the first two pulses, perceived problems with the output transducer resulted from the operation of the transducer at less than the magnitude A.

Figure 5:
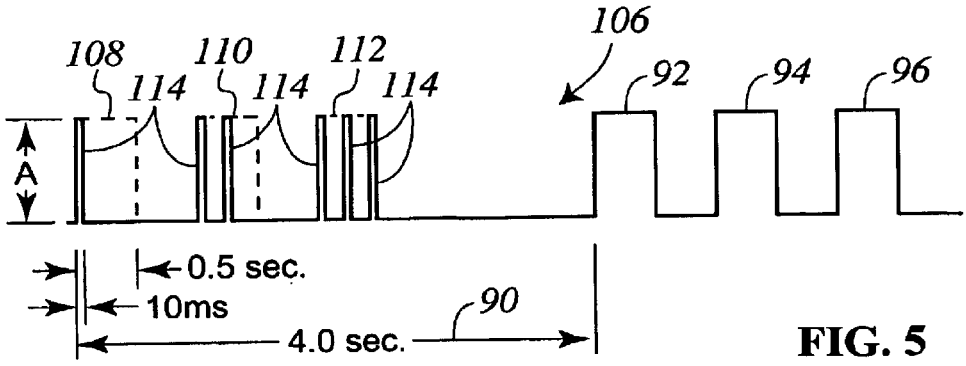
FIG. 5 is the alarm signal generated by the adverse condition detection apparatus of the present invention upon depression of the test switch.

FIG. 5 illustrates the method of the present invention for generating a test signal that uses pulse width modulation (PWM) to reduce the perceived effective acoustic magnitude of a test signal upon activation of the test switch on the adverse condition detector of the present invention. As illustrated in FIG. 5, thereshown is the test signal 106 generated by the microprocessor 22 of the adverse condition detector 18 upon activation of the test switch 60 during normal operating conditions of the detector 18. Upon activation of the test switch 60, the microprocessor 22 generates the test signal 106 that is received by the transducer 24 to generate the audible test signal.

As shown in FIG. 5, the test signal 106 includes three pulse trains 108, 110 and 112 each contained within an envelope, shown by dashed lines, that generally each correspond in time of initiation to the envelope of each alarm pulse 92, 94 and 96, illustrated in FIG. 3. Each of the envelopes of pulse trains 108, 110 and 112 are separated by an off time similar to the off time shown in FIG. 3.

As illustrated in FIG. 5, each of the pulse trains 108, 110 and 112 includes at least one test pulse 114 having a duration substantially less than the duration of the alarm pulses 92, 94 and 96 shown in FIG. 3. In the embodiment of the invention illustrated in FIG. 5, each of the test pulses 114 has a duration of 10 ms, as compared to the 500 ms duration of the alarm pulse 92. Since the test pulse 114 has a duration substantially less than the duration of the alarm pulses, the operation of the transducer upon activation of the test switch will be substantially reduced, thus resulting in a lower effective volume and more easily tolerable audible output signal.

Referring back to FIG. 5, in the embodiment of the invention illustrated, the second pulse train 110 includes a greater number of individual test pulses 114 as compared to the first pulse train 108. Specifically, the second pulse train 110 includes two test pulses 114 spaced from each other by a selected off time. In the embodiment of the invention illustrated, the off time between the two test pulses 114 is about 240 ms.

After the generation of the second test pulse 114 in the second pulse train 110 and the off time between the test envelopes, the third pulse train 112 begins. As illustrated, the third pulse train 112 has a greater number of test pulses 114 as compared to the second pulse train 110. Thus, each successive pulse train has an increasing number of test pulses in the embodiment of the invention illustrated. Specifically, the third pulse train 112 includes three 10 ms pulses each separated by approximately 240 ms. Thus, the third pulse train 112 has a duration substantially equal to the duration of the alarm pulse 96 illustrated in FIG. 3.

Referring back to FIG. 5, each of the test pulses 114 has an amplitude A which is the same as the amplitude A of each alarm pulse illustrated in FIG. 3. Thus, each of the test pulses 114 has a duration substantially shorter than the duration of each alarm pulse 92, 94, 96 while having an amplitude substantially equal to the amplitude of each alarm pulse. In this manner, the transducer coupled to the microprocessor for generating both the alarm signal and the test signal is operated at the same amplitude for both the alarm signal and the test signal. This common amplitude allows the user to observe the test signal and alarm signal at the same amplitude such that the user does not believe the transducer is operating improperly. However, the dramatic reduction in the duration of the test pulses as compared to the alarm pulses allows for a more acceptable test alarm that is not overly loud, annoying, and painful to the user.

As illustrated in FIG. 5, after the test pulses 114 have been generated, the test signal returns to the standard alarm pulses 92, 94 and 96. Thus, the test signal differs from the standard alarm signal only during the first full temporal period of operation. During this first period, the user is able to determine that the adverse condition detector is operating correctly without subjecting the user to the loud sustained volume typically associated with the alarm signal.

In the present invention, each of the pulse trains 108, 110 and 112 are described as having a specific number of test pulses 114. It is contemplated by the inventor that various numbers of test pulses 114 could be included in each of the pulse trains. Additionally, it is contemplated that the duration of each test pulse could also be different than the 10 ms described in the preferred embodiment of the invention. However, the sequence of test pulses 114 illustrated in FIG. 5 were deemed to be the most desirable by the inventor when used in conjunction with the UL217 smoke temporal signal.

Although the present invention has been described as being utilized with a smoke detector having an audible horn, it is contemplated by the inventor that this invention could be utilized in any type of adverse condition detector that utilizes various types of output devices to signal to the user the detected adverse condition. The use of pulse width modulation to vary the alarm signal during test conditions allows the transducer to generate an apparently reduced signal while allowing the transducer to operate at a full amplitude level.

Various alternatives and embodiments are contemplated as being within the scope of the following claims particularly pointing out and distinctly claiming the subject matter regarded as the invention.

I claim:

1. A method for enabling a user to conveniently test an adverse condition detection apparatus, comprising:

providing a test switch on the detection apparatus;

providing an alarm indicator that is activated to generate an alarm signal to alert the user when an adverse condition is detected, the alarm signal having an alarm level and an alarm duration;

generating in the detection apparatus a test alarm signal that is applied to the alarm indicator to activate the alarm indicator when the user activates the test switch, the test alarm signal having a test level and a test duration, the test duration being substantially shorter than the alarm duration.

2. The method of claim 1 wherein the alarm signal includes a plurality of alarm pulses each having the alarm level and an alarm pulse duration.

3. The method of claim 2 wherein the test alarm signal includes a plurality of test pulses, each test pulse having a test pulse duration being substantially shorter than the alarm pulse duration.

4. The method of claim 3 wherein the test alarm signal includes a plurality of pulse trains contained within a test envelope, the test envelope having a duration substantially equal to the alarm pulse duration, wherein each of the plurality of pulse trains includes at least one test pulse.

5. The method of claim 4 wherein each of the plurality of pulse trains includes a greater number of test pulses than the prior pulse train.

6. The method of claim 4 wherein the alarm signal includes three alarm pulses each having the alarm level and the alarm pulse duration, wherein the test alarm signal includes a first pulse train, a second pulse train and a third pulse train, the first pulse train including at least one test pulse, the second pulse train including a greater number of test pulses than the first pulse train, and the third test train including a greater number of test pulses than the second pulse train.

7. The method of claim 6 wherein the second pulse train includes two test pulses and the third pulse train includes three test pulses.

8. The method of claim 2 wherein the test alarm signal includes a plurality of test pulses each having the test pulse level, the test pulse level being substantially equal to the alarm level and the test pulse duration being substantially less than the alarm pulse duration.

9. The method of claim 1 wherein the alarm indicator is a piezoelectric horn.

10. The method of claim 1 wherein the alarm signal is audible.

11. A method of enabling a user to conveniently test an adverse condition detection apparatus, the method comprising the steps of:

providing a test switch on the adverse condition detector;

providing an alarm indicator that is activated to generate an alarm signal to alert users when an adverse condition is detected, the alarm signal having a plurality of alarm pulses each having an alarm level and an alarm pulse duration; and generating in the detection apparatus a test alarm signal when the user actuates the test switch, the test alarm signal having a plurality of test pulses each having a test level and a test pulse duration, the test pulse duration being substantially shorter than the alarm pulse duration.

12. The method of claim 11 wherein the test level is substantially equal to the alarm level.

13. The method of claim 11 wherein the alarm signal is audible.

14. The method of claim 13 wherein the alarm indicator is a piezoelectric horn.

15. The method of claim 11 wherein the test alarm signal includes a plurality of pulse trains each contained within a test envelope, the test envelope having a duration substantially equal to the alarm pulse duration, wherein each pulse train includes at least one test pulse.

16. The method of claim 14 wherein each of the plurality of pulse trains includes a greater number of test pulses than the prior pulse train.

17. The method of claim 15 wherein the alarm signal includes three alarm pulses and the test alarm signal includes three pulse trains, the first pulse train including at least one test pulse, the second pulse train including a greater number of test pulses than the first pulse train, and the third pulse train including a greater number of test pulses than the second pulse train.

18. The method of claim 17 wherein the second pulse train includes two test pulses and the third pulse train includes three test pulses.

19. An adverse condition notification apparatus, comprising:

a detector for detecting an adverse condition, the detector providing an adverse condition signal responsive to detecting the adverse condition;

a control unit operatively coupled to the detector for receiving the adverse condition signal, wherein the control unit generates an alarm signal upon receipt of the adverse condition signal, the alarm signal having an alarm level and an alarm duration;

an alarm indicator operatively connected to the control unit to receive the alarm signal, wherein the alarm indicator generates the alarm signal such that the alarm signal can be detected by the user; and a user actuatable test switch operatively connected to the control unit, wherein the test switch generates an actuation signal received by the control unit upon actuation of the test switch by the user, wherein the control unit generates a test signal upon receipt of the activation signal from the test switch, the test signal being received by the alarm indicator such that the alarm indicator generates the test signal which can be detected by the user, the test signal having a test level and a test duration, the test duration being substantially less than the alarm duration.

20. The apparatus of claim 19 wherein the detector is a carbon monoxide detector.

21. The apparatus of claim 19 wherein the detector is a photoelectric-type smoke detector.

22. The apparatus of claim 19 wherein the detector is a heat detector.

23. The apparatus of claim 19 wherein the alarm indicator is a piezoelectric horn.

24. The apparatus of claim 19 wherein the detector includes both a smoke detector and a carbon monoxide detector.

25. The apparatus of claim 19 wherein the alarm signal includes a plurality of alarm pulses each having the alarm level and an alarm pulse duration, wherein the test signal includes a plurality of test pulses each having the test level and a test pulse duration, the test pulse duration being substantially shorter than the alarm pulse duration and the test level being substantially the same as the alarm level.

26. The apparatus of claim 25 wherein the test signal includes a plurality of pulse trains each contained within a test envelope, the test envelope having a duration substantially equal to the alarm pulse duration, each pulse train including at least one test pulse.

27. The apparatus of claim 26 wherein each of the plurality of pulse trains includes a greater number of test pulses than the prior pulse train.

28. The apparatus of claim 27 wherein the alarm signal includes three alarm pulses and the test alarm signal includes three pulse trains, the first pulse train including at least one test pulse, the second pulse train including a greater number of test pulses than the first pulse train, and the third pulse train including a greater number of test pulses than the second pulse train.

29. The apparatus of claim 28 wherein the second pulse train includes two test pulses and the third pulse train includes three test pulses.

* * * * *